US011151914B1

(12) United States Patent
Verbeure

(10) Patent No.: US 11,151,914 B1
(45) Date of Patent: Oct. 19, 2021

(54) DEFECTIVE PIXEL IDENTIFICATION AND MITIGATION IN MULTI-LAYER LIQUID CRYSTAL DISPLAYS

(71) Applicant: NVIDIA Corporation, Santa Clara, CA (US)

(72) Inventor: Tom J Verbeure, Sunnyvale, CA (US)

(73) Assignee: NVIDIA Corporation

( * ) Notice: Subject to any disclaimer, the term of this patent is extended or adjusted under 35 U.S.C. 154(b) by 0 days.

(21) Appl. No.: 16/844,281

(22) Filed: Apr. 9, 2020

(51) Int. Cl.
*G09G 3/00* (2006.01)
*G09G 3/36* (2006.01)

(52) U.S. Cl.
CPC ..... *G09G 3/006* (2013.01); *G09G 3/3607* (2013.01); *G09G 3/3696* (2013.01); *G09G 2320/0242* (2013.01); *G09G 2330/10* (2013.01); *G09G 2330/12* (2013.01); *G09G 2354/00* (2013.01)

(58) Field of Classification Search
CPC ..... G02F 1/136259; G02F 1/13454; G02F 1/13624; G09G 3/3655; G09G 2300/0465; G09G 2300/0814; G09G 2300/0852; G09G 2320/0247; G09G 2320/0285; G09G 2330/08; G09G 2330/10; G09G 3/3614; G09G 3/3659
See application file for complete search history.

(56) References Cited

U.S. PATENT DOCUMENTS 10,515,599 B2 * 12/2019 Huang ..... G09G 3/3655
2002/0153920 A1 * 10/2002 Lee ..... G09G 3/006 324/760.01
2007/0085805 A1 * 4/2007 Ishii ..... G09G 3/3655 345/98
2017/0169745 A1 * 6/2017 Liu ..... G09G 3/3677

* cited by examiner

*Primary Examiner* — Nelson M Rosario
(74) *Attorney, Agent, or Firm* — Shook, Hardy & Bacon L.L.P.

(57) ABSTRACT

In various examples, defective cells from a first layer of a multi-layer liquid crystal display (LCD) may be compensated for by using one or more cells from a second layer of the multi-layer LCD. Color values corresponding to additional cells of the first layer that may be affected by the compensation of the second layer may also be adjusted to counter the compensation in order to generate a final pixel or sub-pixel value that closely mirrors the desired value from the image data. In addition, backlighting of the LCD may be adjusted such that one or more cells of the backlights—e.g., individual light-emitting diodes (LEDs)—may be adjusted to further aid in compensating for or mitigating the appearance of the defective cell.

20 Claims, 7 Drawing Sheets

DEFECTIVE PIXEL IDENTIFICATION AND MITIGATION IN MULTI-LAYER LIQUID CRYSTAL DISPLAYS

BACKGROUND

Computer monitors, televisions, laptops, hand-held devices, and other device types often implement liquid crystal displays (LCDs) as display panels. LCDs may include single layer (e.g., a red, green, and blue (RGB) layer) or may include two or more layers (e.g., an RGB layer and another layer, such as a monochrome layer). During the production process for LCDs, it is important that each cell within each layer of the LCD is working correctly—e.g., is not defective, dead, always-open (and thus bright, or white), always-closed (and thus black or near-black), etc. For example, a single dead, broken, or otherwise defective cell that corresponds to a pixel or sub-pixel may result in an improper final display that may be noticeable to end-users. These end-users are often highly sensitive to defective or broken pixels or sub-pixels and may return purchased devices that include one or more identifiable defective pixels or sub-pixels.

With the introduction of dual layer LCDs, the problem may be multiplied as each pixel or sub-pixel component in each layer needs to be working properly in order to generate a final cumulative pixel or sub-pixel value that is accurate. As a result, there may be up to twice as many cells subject to potential defect that, if present, could result in an end-user returning the product for refund or exchange.

SUMMARY

Embodiments of the present disclosure relate to defective pixel identification and mitigation in multi-layer liquid crystal displays (LCDs). Systems and methods are disclosed that provide for identifying one or more defective pixels or sub-pixels in a first layer of an LCD and compensating for the defective pixels or sub-pixels using a second layer of the LCD and/or backlighting (e.g., light-emitting-diode (LED) backlighting) of the LCD. As a result, manufacturers may identify, account for, and remedy manufacturing defects prior to shipment to end-users—thereby resulting in a larger percentage of LCDs being without defect and thus acceptable to end-users. In addition, end-users may be able to remedy any defects that may arise after purchase and during use, thereby extending the life cycle of the LCD displays.

In contrast to conventional systems, such as those described above, embodiments of the present disclosure leverage an additional layer(s) of the multi-layer LCD to compensate for or mitigate defects in another layer. For example, where a cell from a first layer corresponding to a pixel or sub-pixel is determined to be defective, a corresponding cell from a second layer may be used to mitigate or compensate for the effect of the defective cell on the final display. In addition, because adjustments to a value corresponding to a cell in the second, mitigating layer may affect more than one cell in the first layer, the values of the non-defective cells in the first layer may be adjusted to offset the mitigating effect of the cell in the second layer. As a result, the appearance of the defective cell in the first layer may be remedied while the other cells in the first layer may still contribute to a final display that mirrors the desired output as closely as possible. In addition, in some embodiments, backlighting of the LCD may be adjusted to further compensate for or mitigate defective cells in one or more layers of the LCD. For example, luminance values of one or more backlights (e.g., LEDs—such as micro LEDs) most closely corresponding to a defective cell may be adjusted to account for the defective cell—e.g., the luminance value may be increased where a cell is always-closed and the luminance value may be decreased where a cell is always-open. Thus, adjustments to color values (e.g., capacitance charge values) from one or more cells of one or more layers of the LCD—in addition to adjustments to backlighting—may be made in an effort to compensate for or mitigate defective cells in another layer of the LCD.

BRIEF DESCRIPTION OF THE DRAWINGS

The present systems and methods for defective pixel identification and mitigation in multi-layer liquid crystal display (LCDs) are described in detail below with reference to the attached drawing figures, wherein.

DETAILED DESCRIPTION

Systems and methods are disclosed related to defective pixel identification and mitigation in multi-layer liquid crystal display (LCDs). Although the description herein is primarily directed to dual-layer LCDs, this is not intended to be limiting, and any number of liquid crystal (LC) layers may be implemented without departing from the scope of the present disclosure. In addition, although the LC layers primarily described herein are red, green, and blue (RGB) layers and monochrome (Y) layers, this is not intended to be limiting, and any combination of layers including but not limited to those described herein may be implemented without departing from the scope of the present disclosure. Further, although cells may be referred to as defective cells generally, a defective cell may include a broken, dead, always-open, always-closed, and/or other type of defective cell. Although the present disclosure primarily relates to LCD technology—and specifically to multi-layer LCD technology—this is not intended to be limiting, and the systems and methods described herein may additionally or alternatively be applicable to any display technology, such as light emitting diode (LED) displays, organic LED (OLED) displays, plasma displays, active-matrix OLED (AMOLED) displays, LED/LCD displays, and/or other display types.

Embodiments of the present disclosure may correspond to multi-layer LCDs capable of providing increased contrast ratios as multiple LCD panels are stacked one on top of the other. This architecture allows for a multiplicative effect on the amount of light that can pass through for a particular pixel. For example, for each pixel, the following holds true: $Color_{final}=Color_{cell-1}*Color_{cell-2}*Color_{cell-n}$, where n may correspond to the number of cells from a number of layers that are in series. The benefit of additional layers is that a much higher dynamic range of the amount of light that can be regulated through a pixel. As an example, if each cell (or valve) has a contrast ratio—equal to a ratio of an amount of light between when the cell is fully open and fully closed—of 1000, then putting two cells (or valves) from two layers in series allows for a theoretical contrast ratio of 1,000,000 (e.g., 1000×1000). As a result, multi-layer LCDs allow for high dynamic range (HDR) displays where very bright colors can coexist next to very dark black with minimal light bleeding. The displays of the present disclosure, in addition to or alternatively supporting HDR, may further support other high-fidelity display technologies such as, but not limited to, DOLBY VISION, DOLBY VISION IQ, HDR10+, mobile HDR, SMPTE ST 2084 or 2086, etc.

Figure 1A:
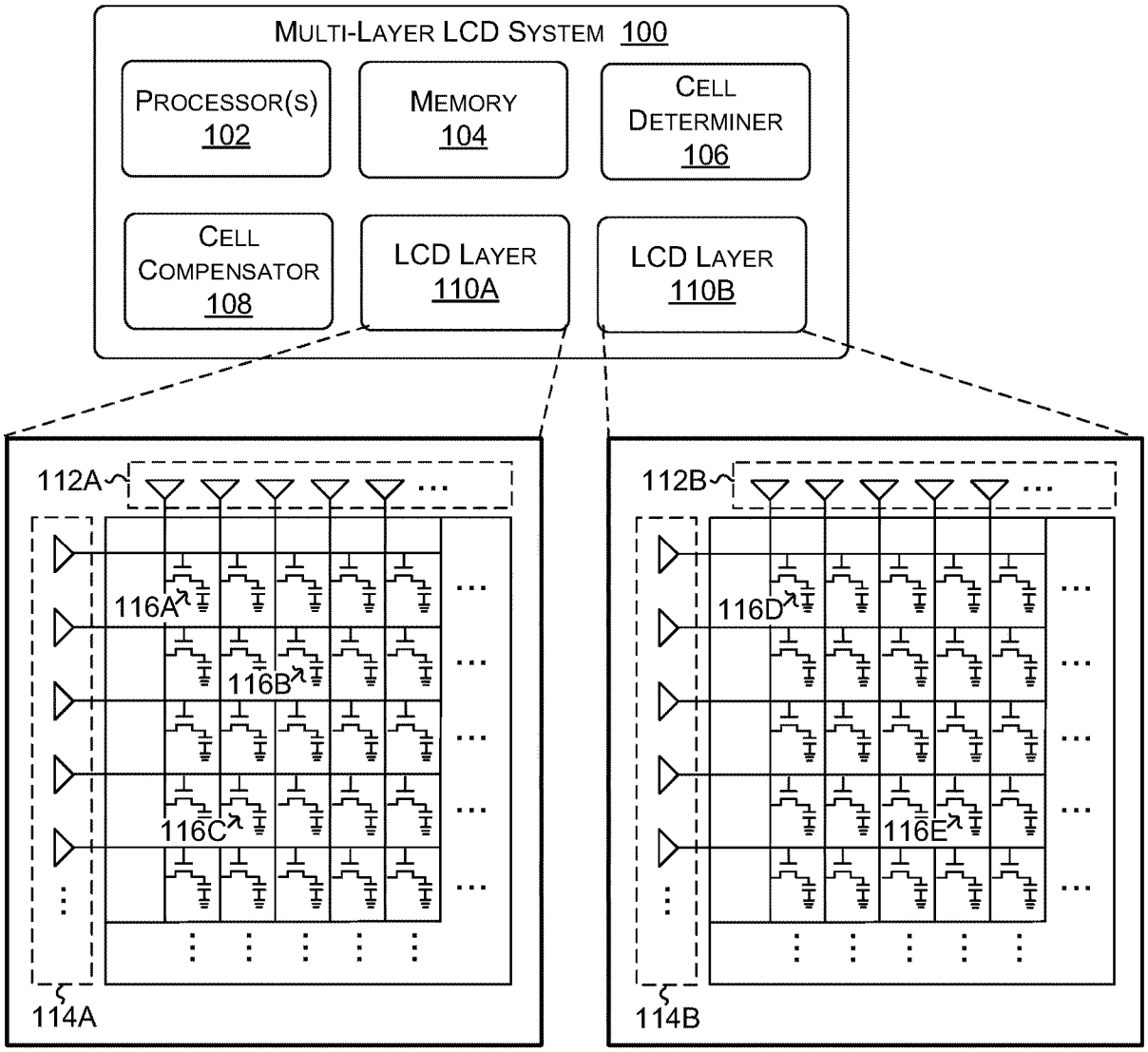
FIG. 1A depicts a multi-layer LCD system for defective pixel identification and mitigation, in accordance with some embodiments of the present disclosure.

Now with reference to FIG. 1A, FIG. 1A depicts an example multi-layer LCD system 100 for dead pixel identification and mitigation, in accordance with some embodiments of the present disclosure. It should be understood that this and other arrangements described herein are set forth only as examples. Other arrangements and elements (e.g., machines, interfaces, functions, orders, groupings of functions, etc.) may be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by entities may be carried out by hardware, firmware, and/or software. For instance, various functions may be carried out by a processor executing instructions stored in memory. In some embodiments, one or more of the components, features, and/or functionality of the multi-layer LCD system 100 may be executed using one or more of the components, features, and/or functionality of example computing device 500 of FIG. 5.

The multi-layer LCD system 100 (abbreviated as "system 100" herein) may include one or more processors 102 (e.g., central processing units (CPUs), graphics processing units (GPUs), etc.), memory 104 (e.g., for storing image data rendered by the processor(s) 102, for storing locations of defective cells, etc.), a cell determiner 106, a cell compensator 108, an LCD layer 110A, an LCD layer 110B, one or more additional LCD layers 110 (not shown), and/or additional or alternative components, features, and functionality. In some embodiments, the system 100 may correspond to a single device (e.g., an LCD television), or a local device (e.g., a desktop computer, a laptop computer, a tablet computer, etc.), and the components of the system 100 may be executed locally on the system 100.

In other embodiments, some or all of the components of the system 100 may exist separately from the LCD panel or display. For example, the cell determiner 106, the memory 104, the cell compensator 108, the processor(s) 102, and/or other components may be part of another system separate from the LCD panel or display—e.g., such as in a cloud-based system communicatively coupled to the LCD panel or display. In such embodiments, the remote or separate system may store information corresponding to the LCD panel or display (e.g., information about defective cell locations, device information such as resolution, and/or other information), and this information may be leveraged by the remote system to generate the color values that may take into account the defective cells. As a result, the LCD panel or display—or device associated therewith—may directly receive the image data in an already compensated form (e.g., with updated values for compensation cells) such that the image data may be directly applied to cells 116 of the LCD panel or display. For example, the remote or separate system may render or otherwise generate a sub-image corresponding to each LCD layer, where one or more of the sub-images may include color, pixel, or sub-pixel values that were determined to compensate for one or more defective cells, and/or to compensate for the compensation of a compensation cell, as described in more detail herein. As such, the LCD panel or display may be capable of operating in a cloud-streaming environment and/or a remote desktop implementation, where the data received is already compensated based on the respective LCD panel or display. In such embodiments, the remote system may thus generate unique instances of the image data for each respective LCD display based on the defective cell information and/or the display characteristics or attributes for the respective display. A benefit of a cloud-based system for defective pixel identification and mitigation is that LCD displays that were not manufactured or developed with this intrinsic technology may still benefit from the compensation logic described herein. For example, an LCD display without this technology could still receive the image data after compensation and display the compensated or updated image data without having to have the hardware and/or software onboard to do so (e.g., the LCD display would not recognize a difference between original image data and compensated image data).

The processor(s) 102 may include a GPU(s) and/or a CPU(s) for rendering image data representative of still images, video images, and/or other image types. The image data may be received via one or more external devices, in some embodiments, such as over a wide-area network using a cloud streaming application, over a local area network using a computing device, a smart phone, and/or the like, and/or from a local or internal device such as a set-top box, a disc player, a game console, a streaming device, and/or the like. Once rendered, or otherwise suitable for display by the multi-layer LCD system 100, the image data may be stored in memory 104. In some embodiments, the image data may be representative of an image per LCD layer 110—e.g., one image per respective LCD layer 110 of the multi-layer LCD system 100. The two or more images, when displayed, are combined optically to generate a final displayed image. As such, an original image may be generated as a sub-image for each respective LCD layer 110, and the combination of the sub-images applied to each of the LCD layers 110 may generate a representation of the original image through the multi-layer LCD.

The processor(s) 102 may further execute instructions stored in memory 104 to cause instantiations of the cell determiner 106, the cell compensator 108, and/or other components, and may execute instructions for driving row drivers 114 and/or column drivers 112 of the LCD layers 110 according to the image data—e.g., according to color values, [0, 255], for respective cells 116 as determined from the image data.

In some embodiments, the memory 104 may further store locations of defective cells 116 and/or an indication of the type of defect (e.g., always-on, always-off, dead, only capable of half capacitance charge, etc.) with respect to one or more of the defective cells—such as, without limitation, in content-addressable memory (CAM). For example, the hardware and/or software that drives the LCD layers 110 may include a lookup table (e.g., stored in memory 104) that may use the pixel coordinates or cell coordinates (e.g., where there are more cells 116 than pixels, such as in an RGB layer) as a lookup address. In some embodiments, the size of the lookup table may include a limited capacity—e.g., 5, 10, 15, 25, etc.—addresses to account for the limited number of defective cells that may be present in a particular LCD panel (e.g., because a manufacturer may only allow a small number of defective pixels to be present in order to pass through quality assurance (QA) measures). As such, this information may be used—e.g., prior to scanning the image data out of the memory 104 for display—to update the image data to compensate for the defective cell(s). For example, updating the image data may include adjusting color values (and thus voltage and/or capacitance values) for one or more cells 116 other than the defective cell. The updated color values may correspond, in embodiments, to a cell 116 from a different LCD layer 110 as the defective cell that corresponds to the same pixel as the defective cell. As a result, the cell 116 with the updated value may be referred to herein as a compensation cell. In some embodiments, where the defective cell corresponds to a sub-pixel—e.g., a red sub-pixel, a green sub-pixel, or a blue sub-pixel of an RGB layer—one or more cells 116 corresponding to other of the sub-pixels may also have color values (and thus voltage and/or capacitance values) adjusted to compensate for the compensation cell, as described in more detail herein at least with respect to FIGS. 3A-3D. Once the image data is updated based on the defective cell information from the memory 104, the updated image data may be scanned out to for display by applying voltages and thus capacitance values determined from the updated image data to each cell of the LCD layers 110—e.g., via the row drivers 114 and the column drivers 112.

The cell determiner 106 may determine, using the image data and/or the defective cell information stored in memory 104, which pixel information corresponds to which defective cell. This determination may then be used to determine which values from the image data need to be updated to compensate for the defective cell. For example, assuming that cell 116A of the LCD layer 110A is defective, the cell determiner 106 may determine the corresponding cell(s) 116 from the LCD layer 110B—e.g., cell 116D. In some embodiments, a cell 116 from one LCD layer 110 may correspond to a plurality of cells 116—including cells 116 that correspond to more than one pixel—from another LCD layer 110. As such, the cell determiner 106 may determine which compensation cell corresponds to a defective cell and/or may determine each other cell that may not be defective but may be affected by the adjustments to the compensation cell (e.g., the compensation cell may be adjusted to compensate for a defective cell, but the compensation may effect one or more additional cells other than the defective cell). As a result, the cell determiner may include a number of different cells 116 that receive some level of adjusted values (e.g., color values, voltage values, capacitance values, etc.). This information from the cell determiner 106 may then be used to determine—e.g., by the cell compensator 108—which portion or segment of the image data needs to be adjusted to compensate for the defective cell 116A. For example, where the defective cell 116A is always-open but the color value for the defective cell 116A corresponds to a darker shade, the color values from the image data corresponding to the cell 116D may be adjusted to compensate for—e.g., darken—the output from the defective cell 116A such that the final pixel color is closer to the original pixel color that would be generated had the cell 116A not been defective.

The cell compensator 108 may determine the adjustments that need to be made to compensate for the cell(s) 116 that is defective. For example, the values from the image data may be adjusted, the voltage to be applied to the compensation cell(s) (e.g., cell 116D in the above example) may be adjusted, the capacitance value for the compensation cell(s) may be adjusted, and/or other adjustments may be made—such as to the backlighting—to compensate for the defective cell(s) (e.g., the cell 116A in the above example). Various examples of defective cells and compensation therefore are described herein at least with respect to FIGS. 3A-3D.

The LCD layers 110 (e.g., 110A and 110B) may include any number of cells 116 (or valves) that may each correspond to a pixel or a sub-pixel of a pixel. For example, the LCD layers 110 may include an RGB layer where each cell 116 may correspond to a sub-pixel having an associated color (e.g. red, green, or blue) associated therewith via one or more color filter layers of the multi-layer LCD system 100 (described in more detail herein at least with respect to FIG. 2). As such, a first cell 116 may correspond to a first sub-pixel with a red color filter in series therewith, a second cell 116 may correspond to a second sub-pixel with a blue color filter in series therewith, and so on. Although an RGB layer is described herein, this is not intended to be limiting, and any different individual color or combination of colors may be used depending on the embodiment.

In some embodiments, the LCD layers 110 may include a monochrome or grayscale (Y) layer that may correspond to some grayscale range of colors from black to white. As such, a cell 116 of a Y layer may be adjusted to correspond to a color on the grayscale color spectrum. The Y layer may correspond to, without limitation, a monochrome color palette, a 2-bit grayscale color palette, a 4-bit grayscale color palette, an 8-bit grayscale color palette, and so on.

Although the LCD layer 110A and LCD layer 110B are illustrated as being similar (e.g., including a similar number of cells 116, row drivers 114, column drivers 112, etc.), this is not intended to be limiting. For example, if both the LCD layer 110A and the LCD layer 110B include a similar layer type—such as RGB, grayscale, etc.—then the number and layout of the cells 116 may be similar. However where, for example, the LCD layer 110A is an RGB layer and the LCD layer 110B is a grayscale or Y layer, the number of cells 116, row drivers 114, and/or column drivers 112 may differ. In such an example, for each pixel, the RGB layer may require three separate cells 116 (one for red, one for green, and one for blue), while the Y layer may only require a single cell 116 (e.g., to be adjusted to a grayscale level). As such, the RGB layer (e.g., LCD layer 110A in this example) may include three times as many cells 116 as the Y layer (e.g., LCD layer 110B in this example). As a result, the layout of the cells 116 may be different such that cell 116A, for example, may include three separate cells 116 aligned side by side from left to right across a row. In addition, because of the three separate cells 116 for each pixel, there may be three times as many column drivers 112 in the RGB layer than the Y layer to drive the voltage values corresponding to each respective cell 116. As such, the example illustration of FIG. 1A is not intended to be limiting, and each LCD layer 110 of the multi-layer LCD system 100 may include different numbers of components, different orientations of components, and/or different operability between and among the components, depending on the embodiment.

As a further non-limiting example, where the system 100 corresponds to a 4K resolution LCD display (e.g., 3840 pixels×2160 pixels), and the LCD layer 110A is an RGB layer and the LCD layer 110B is a Y layer, the RGB layer may include 11520 (e.g., 3840 pixels×3 sub-pixels per pixel) cells 116 in each row, 11520 column drivers 112, 2160 cells 116 in each column, and 2160 row drivers 114, and the Y layer may include 3840 cells 116 in each row, 3840 column drivers 112, 2160 cells 116 in each column, and 2160 row drivers. Although 4K is used as an example, the resolution may differ depending on the embodiment, and may include 1080p, 8k, 16k, and/or another resolution without departing from the scope of the present disclosure.

Once the values (e.g., color values, voltage values, capacitance values, etc.) are determined for each cell 116 of each LCD layer 110—e.g., using the cell determiner 106, the cell compensator 108, etc.—signals corresponding to the values may be applied to each cell via the row drivers 114 and the column drivers 112. For example, for cell 116A, a row driver 114 corresponding to the row of the cell 116A may be activated according to a shift register (e.g., activated to a value of 1 via a corresponding flip-flop), and a column driver 112 corresponding to the column of the cell 116A may be activated to drive a signal—e.g., carrying a voltage—to a transistor/capacitor pair of the cell 116A. As a result, the capacitor of the cell 116A may be charged to a capacitance value corresponding to the color value for the current frame of the image data. This process may be repeated—e.g., from top left to bottom right, middle-out, etc.—for each cell 116 of each LCD layer 110. In instances where a defective cell exists, the values driven to the compensation cells may be different from the values that would be driven were a respective—e.g., in series—defective cell not present. In addition, in some embodiments, a different value may also be driven to a defective cell—such as by driving no voltage to the defective cell, driving a highest voltage to the defective cell, etc. Where no voltage is applied to known defective cells, the overall power supplied to the multi-layer LCD system 100 may be reduced over a life of the device—thereby resulting in lower electricity usage.

Figure 1B:
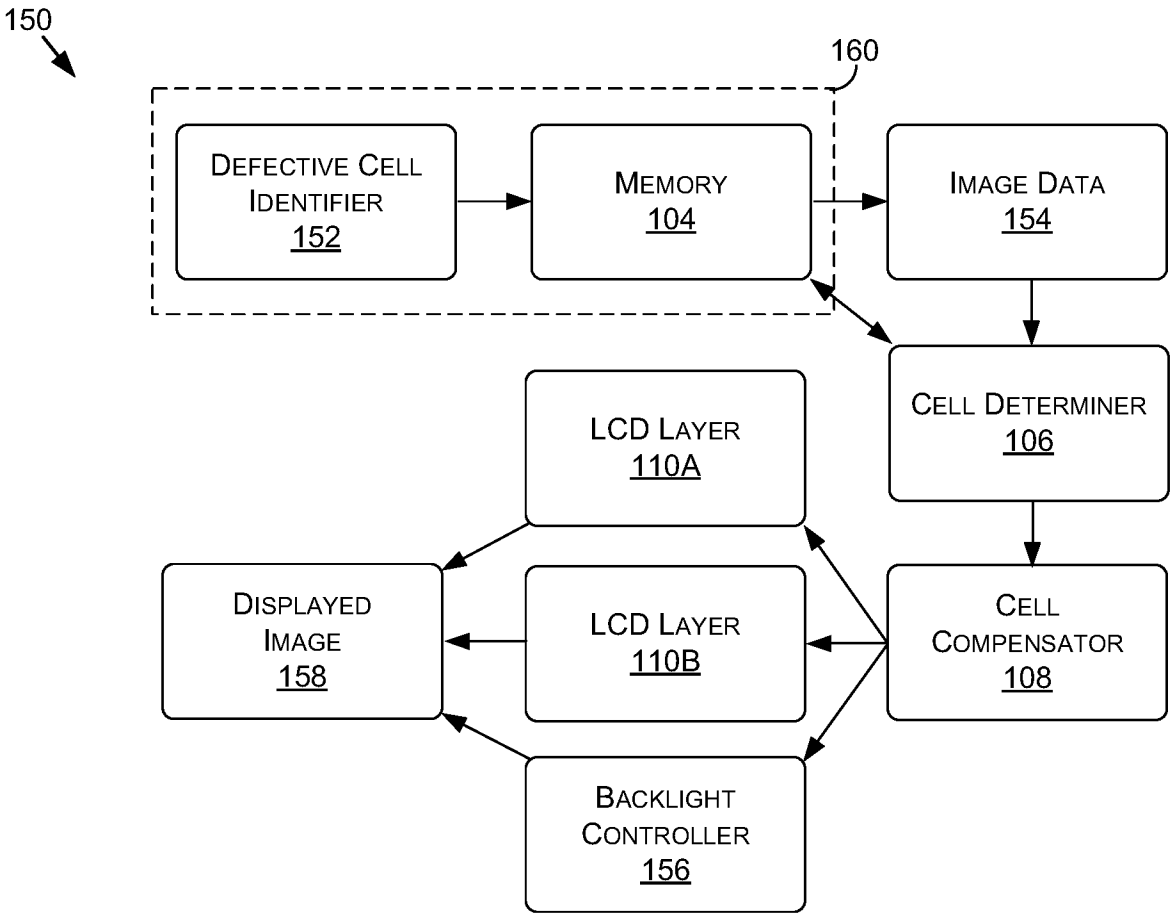
FIG. 1B depicts an example data flow diagram for a process of defective pixel identification and mitigation, in accordance with some embodiments of the present disclosure.

Now referring to FIG. 1B, FIG. 1B depicts an example data flow diagram for a process 150 of defective pixel identification and mitigation, in accordance with some embodiments of the present disclosure. The process 150 may be executed using some or all of the components of the system 100 of FIG. 1A, and/or may be executed using additional or alternative components such as but not limited to those described herein. The process 150 may include a defective cell identifier 152 for identifying defective cells of the cells 116 for a respective multi-layer LCD system 100. This process may be manual—e.g., with user involvement, such as via a diagnostic application or other application associated with the LCD system 100—and/or may be automatic using any defective cell detection technique including but not limited to those described herein. Once the defective cells are identified, this information may be stored in memory 104, as described herein. The memory 104 (e.g., the portion of the memory 104 storing defective cell information) and the defective cell identifier 152 may be referred to as a defective cell identification system 160—as indicated by the dashed lines. In some embodiments, the defective cell identification system 160 may be included as part of the multi-layer LCD system 100 (e.g., as hardware and/or software integral to the LCD device), while in other embodiments, some or all of the components, features, and/or functionality of the defective cell identification system 160 may be separate from the system 100. For example, a first device may determine the defective cells via the defective cell identifier 152, and a second device—e.g., the system 100—may store the defective cell information in memory 104. In yet further embodiments, the defective cell identification system 160 may exist completely separate from the system 100—such as in a cloud-based system, as described herein—and the defective cell identification system 160 may be leveraged prior to and/or during use of the system 100 to determine the defective cells.

The defective cell identifier 152 may identify or determine the cells using one or more manual approaches. For example, the defective cell identifier 152 may generate a test or diagnostic image(s) for display on the multi-layer LCD system 100. The diagnostic image may include a fully black image, a fully white image, a fully red image, a fully blue image, a fully green image, and/or another image type that may aid in identifying a broken pixel (e.g., where a diagnostic image is fully black, a white pixel on a black display may be a clear indication of a defective cell corresponding to the pixel). Once the diagnostic image is displayed, one or more manual processes may be executed to test for a defective cell. For example, a device (e.g., a camera, a smart phone, a tablet computer, etc.) that includes an image sensor may capture an image of the system 100 when the diagnostic image is being displayed. The diagnostic image data captured by the device including the image sensor may then be analyzed by the defective cell identifier 152 (e.g., using a computer vision algorithm, a deep neural network (DNN) trained for defective pixel identification, and/or another technique) to determine a pixel—e.g., a corresponding cell causing the pixel's color—that is defective. This process may be repeated across one or more diagnostic images to determine each cell 116 that has a defect (e.g., for a red diagnostic image, it may be determined a cell corresponding to a red sub-pixel has a defect, and for a black diagnostic image, it may be determined a cell corresponding to a Y layer grayscale or monochrome pixel has a defect, and so on).

As another example, the same diagnostic image data captured using the device that includes an image sensor may be analyzed—e.g., within an application executing on the device—by a user to identify the defective cells 116 or pixels. For example, a user may view the diagnostic image corresponding to the diagnostic image data captured of the system 100, and may provide an input—e.g., via a mouse, a touch screen, a remote, etc.—indicative of a pixel or cell that is defective.

As a further example, in some embodiments, a user may interact with the system 100 itself to identify the defective pixel. For example, as the system 100 displays the diagnostic image, the user may control a cursor—e.g., using a mouse, a remote control, a stylus, a finger, etc.—to point to a defective pixel or cell 116 on the display of the system 100.

In some embodiments, the determination of a defective cell may be an automatic process performed by the system 100. For example, each cell 116 may have some voltage or capacitance value applied thereto (e.g., equivalent to a maximum value), and then the capacitance of each cell 116 may be drained and recorded to determine the capacitance actually held by each cell 116. As such, where a maximum value is applied to a cell 116, and the recorded voltage after discharge is less than the maximum, this may be indicative of a defective cell. Similarly, a minimum value may applied to each cell 116, and the capacitance of each cell 116 may then be measured or recorded. In such an example, where a recorded voltage after discharge is greater than a minimum (e.g., where there is a voltage reading but should not be), the cell 116 may be determined to be a defective cell.

In any of the examples described herein, in addition to other techniques for defective cell identification, the determined defective cells may be stored in the memory 104. As described herein, the memory 104 that stores the defective cell information may include a CAM that addresses the defective cells by pixel or cell location within the display.

The process 150 may further include image data 154 being received and/or or generated by the system 100. For example, as described herein, one or more processors 102 of the system 100 and/or a remote or separate system may generate the image data 154. In some embodiments, the image data 154 may be representative of an original image and/or may be representative of one or more sub-images (e.g., one per LCD layer 110) that correspond to an original image. In other embodiments, the image data 154 may be already compensated image data—such as in embodiments where the cell determiner 106 and the cell compensator 108 are associated with a remote or separate system than the system 100.

In some embodiments, the cell determiner 106 may use the defective cell information from the memory 104 to determine which cells 116 should be compensated for based on the image data 154. This may include determining which cells are defective, which cells correspond to—and thus could be leveraged as compensation cells for—the defective cells, and/or which portions or segments of the image data 154 need to be adjusted to perform the compensation. As described herein, because the compensation cells may have a ripple effect one or more non-defective cells (e.g., where a compensation cell is in series with more than a defective cell), the cell determiner 106 may also determine the other cells that need to have adjusted values to compensate for the compensation of the compensation cell.

The cell compensator 108 may determine the compensation that is necessary to account for the defective cell and/or the cells affected by the compensation for the defective cell. For example, the cell compensator 108 may determine the adjustments to the voltage values to be applied to one or more cells 116, the color values from the image data 154 to generate updated image data, and/or the capacitance values for the cells 116 that require adjustment.

Once the adjustments have been made, signals may be generated and transmitted or applied to the LCD layer 110A, the LCD layer 110B, one or more other LCD layers 110 (not shown), and/or the backlight controller 156 for adjusting one or more lighting units of the backlight. For example, luminance values for each cell 116 may be determined and applied—e.g., via a voltage—to each of the cells 116 via the row drivers 114 and the column drivers 112. As such, a first subset of the image data (e.g., after compensation, and corresponding to a first sub-image) may be applied to the LCD layer 110A, a second subset of the image data (after compensation, and corresponding to a second sub-image) may be applied to the LCD layer 110B, and/or backlight control (e.g., luminance) values may be applied—e.g., via a voltage—to the lighting units of the backlight via the backlight controller 156.

The combination of the applied values to the LCD layer 110A, the LCD layer 110B, and the backlight lighting units may generate a displayed image 158. The displayed image—e.g., due to compensation during the process 150—may be displayed as close to an image represented by the image data 154 as possible. For example, due to the compensation for the defective cells of the system 100, the displayed image 158 may more closely resemble the image represented by the image data 154 than if no compensation were applied via the process 150. As a result, end-users may notice no visible difference between an LCD display with one or more defective pixels and an LCD display with no defective pixels. This may result in less returns of LCD displays with defective pixels, thereby decreasing the waste of LCD displays—or devices including LCD displays—as compared to LCD displays with no compensation logic being employed.

Figure 2:
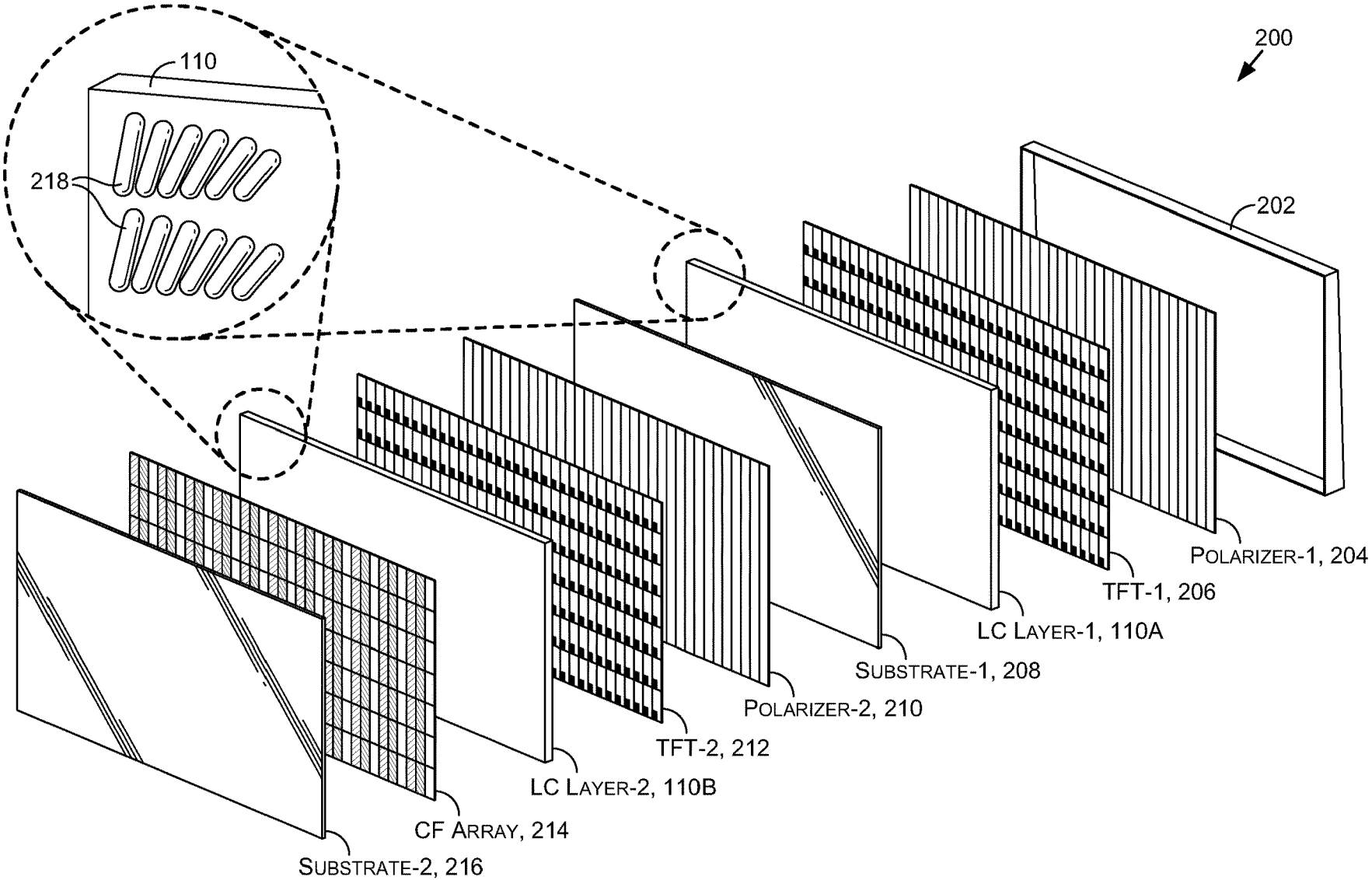
FIG. 2 depicts an example layer structure for a multi-layer LCD, in accordance with some embodiments of the present disclosure.

Now referring to FIG. 2, FIG. 2 depicts an example layer structure for a multi-layer LCD 200, in accordance with some embodiments of the present disclosure. Although various layers are illustrated with respect to FIG. 2, this is not intended to be limiting and is for example purposes only. For example, the layers of the system 100 may include some or all of the layers of the multi-layer LCD 200, and/or may include additional or alternative layers not illustrated in FIG. 2. In addition, the order of the layers of the multi-layer LCD 200 are not intended to be limiting, and are for illustrative purposes only. Any order of layers—including the layers illustrated and/or additional or alternative layers—may vary depending on the embodiment.

A backlight 202 may include one or more lighting units—e.g., individual bulbs, such as LEDs or micro LEDs—that may generate the light for the multi-layer LCD 200. In some examples, the backlight 202 may include enough lighting units such that a ratio of lighting units to cells of the LCD layers 110 is low (e.g., 1:1, 1:3, 1:10, 1:15, 1:20, etc.). In such embodiments, and as described herein, adjustments may be made to the lighting units that correspond to defective cells and/or cells affected by the compensation for defective cells to aid in generating final color values for pixels that most closely resemble an original or desired image.

A polarizer 204 may be used to optically filter light from the backlight 202 such that only light waves of a specific polarization pass through while blocking light waves of other polarizations. For example, the polarizer 204 may filter all light waves except for vertical or horizontal light waves, and polarizer 210 may filter the light waves that are perpendicular to—e.g., at a right angle, or 90 degrees, with respect to—the light waves filtered by the polarizer 204. As such, the LCD layers 110 may be used to change the polarization of the light waves such that the polarizer 210 does not filter out all of the light waves polarized by the polarizer 204.

The thin-film-transistor (TFT) layer 206 may include a transistor for each cell 116 of the LCD layer 110A, and the TFT layer 212 may include a transistor for each cell 116 of the LCD layer 110B. The TFT layers may thus be used as switching devices for allowing a charge or not allowing a charge to be applied to a capacitor of a cell 116.

The substrate 208 may include a glass substrate that may generate a sandwich for the LCD layer 110A. In some examples, the substrate 210 may include a color filter, such as monochrome or grayscale color filter (e.g., a Y color filter), while in other examples, the substrate 208 may be used to generate the difference in voltage between the TFT layer 206 and the substrate 208 for determining a state of the LCs.

The color filter (CF) array layer 214 may include a color filter depending on the type of layer the LCD layer 110B corresponds to. For example, where the LCD layer 110B corresponds to an RGB layer, the CF array layer 214 may include color filters of red, green, and blue for each pixel, and the LCD layer 110B may include a cell for each sub-pixel color (e.g., 3 cells per pixel).

The substrate 216 may be similar to the substrate 208. In some embodiments, the substrate 216 may include a glass substrate that may include a final layer of the multi-layer LCD 200 that may be form at least a portion of an outer housing of the multi-layer LCD.

The LC layers 110 may include liquid crystals (LCs) 218, which may be manipulated using voltages to act as a light wave modifying element. For example, the voltage applied to the LCs 218 may determine a shift in phase of the light waves applied thereto, such that the more the light waves are shifted between 0 and 90 degrees, the more light reaches the final display (e.g., because the polarizer 210 may filter closer to 100% of the light waves with 0 degrees of shift but may filter closer to 0% of the light waves with 90 degrees of shift).

Now referring to FIGS. 3A-3D, FIGS. 3A-3D depict example illustrations of compensating for defective cells in a layer of an LCD display using cells from other layers and/or backlighting adjustments, in accordance with some embodiments of the present disclosure. For example, with respect to FIG. 3A, a pixel 330A may include cells 302A, 302B, and 302C that correspond to R, G, and B components of an RGB layer, respectively, and a cell 302D that correspond to a grayscale or monochrome layer. As such, if the pixel 300A requires a final color with very high R and G values and a low B value, the Y value may typically be very high as well. However, if the cell 302C is defective—e.g., always-open—the result may be a very high B value where a low B value is desired, thus resulting in a noticeable difference. To compensate for this defective cell 302C, the value applied to the cell 302D may be adjusted. For example, although a very high value may correspond to the cell 302D based on the original image data, after compensation the value applied to the cell 302D may be a much lower value to block the incorrect light that is coming through the defective cell 302C. In contrast, were the B value very high based on the original image data, the defective cell—e.g., an always-on cell in this example—may still contribute to the final output without a need for compensation.

Additionally, in some embodiments, as a result of the compensation by the cell 302D for the cell 302C, the amount of light that is expected to be passed through the cells 302A and 302B may be affected—e.g., because the cell 302D is also in series with the cells 302A and 302B. In such examples, the values of the cells 302A and 302B may also be compensated to compensate for the compensation of the cell 302D. For example, where an R value would originally be 155 on a scale of [0, 255], an updated R value of 200 may be applied to the cell 302A. Similarly, where a G value would originally be 180 on the same scale, an updated G value of 210 may be applied, for example. As a result, the final output color of the pixel 300A may be as close as possible to the desired output from the original image data 154.

Figure 3B:
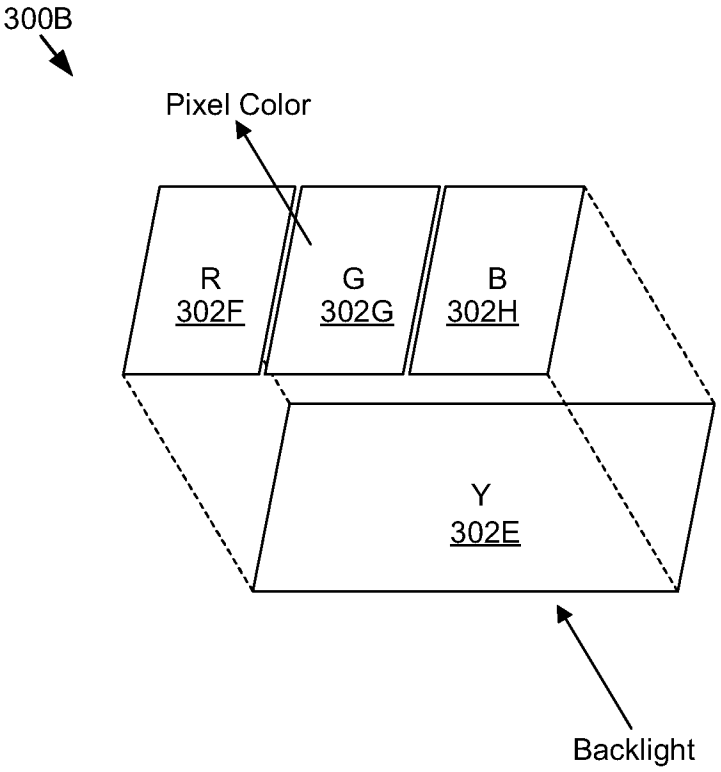
FIGS. 3A-3D depict example illustrations of compensating for defective cells in a layer of an LCD using cells from other layers and/or backlighting adjustments, in accordance with some embodiments of the present disclosure.

Referring to FIG. 3B, a pixel 300B may include a similar RGB and Y layer as the pixel 300A, but in reverse order. For example, the Y LCD layer 110 may be before the RGB LCD layer 110 in series. As such, similar to the description with respect to the pixel 300A, the values of the cells 302E, 302F, 302G, and 302H may be adjusted to compensate for a defective cell and/or to compensate for the compensation for a defective cell.

Figure 3A:
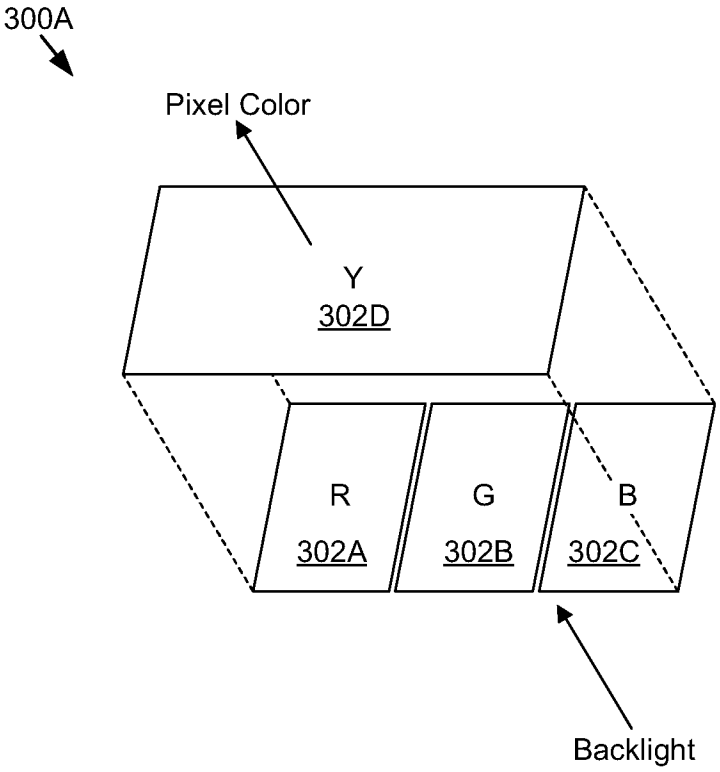
Figure 3D:
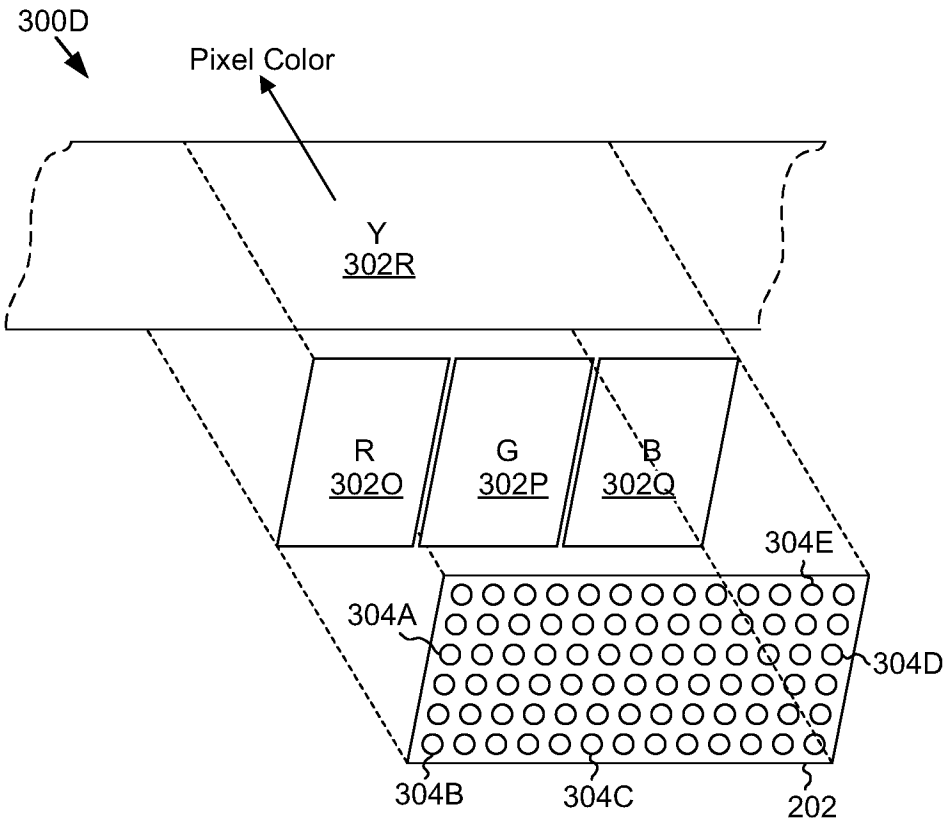
Figure 3C:
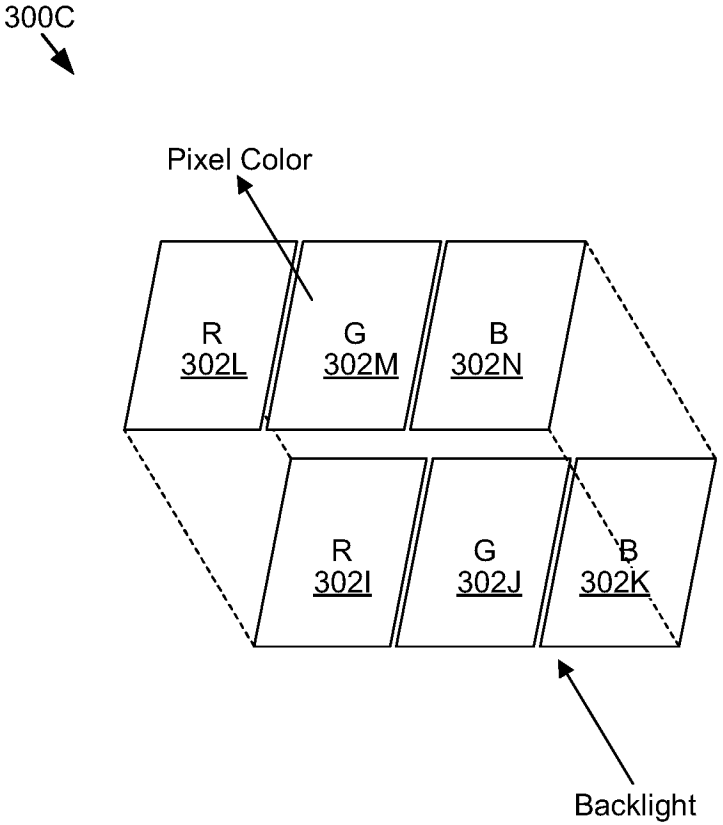

Now referring to FIG. 3C, a pixel 300C may include an LCD display with two RGB layers, a first RGB layer including the cells 3021, 302J, and 302K and a second RGB layer including the cells 302L, 302M, and 302N. In such an example, where an R value is intended to be high, but the cell 3021 is in an always-closed defective state, the value applied to the cell 302L may be adjusted to compensate for the defective cell 3021. For example, the value applied to the cell 302L may be increased from an original value corresponding to the original image data prior to compensation. As a result, even though the cell 3021 may not be allowing much light to pass though, the value of the cell 302L being adjusted to allow most if not all of the light through may compensate for the cell 3021 such that at least some of the R component in the final pixel color is realized.

With reference to FIG. 3D, a pixel 300D may include similar layers with a similar order with respect to the pixel 300A of FIG. 3A, except cell 302R corresponding to a Y LCD layer 110 may extend beyond a single set of RGB sub-pixel cells 302O, 302P, and 302Q. As such, in view of a similar example with respect to FIG. 3A, where the values applied to the cell 302R are adjusted to compensate for a defective B cell 302Q, the impact of the adjustment to the cell 302R may extend beyond the cells 302O and 302P to adjacent RGB cells of an adjacent pixel(s) (not shown). As such, these adjacent cells corresponding to adjacent RGB sub-pixels may also have values applied to or corresponding to them adjusted to compensate for the compensation of the cell 302R. For example, where the cell 302R is adjusted such that less light is allowed through, each of the values corresponding to an adjacent RGB sub-pixel cell set may be adjusted to increase the amount of light allowed there though to compensate for the reduction in the amount of light that the cell 302R is going to allow to pass.

As a further example, and with respect to the backlight 202, in some embodiments luminance values corresponding to one or more individual lighting units 304 (e.g., lighting units 304A-304E, which may each correspond to a single LED or other lighting unit type) may be adjusted to compensate for a defective cell. It should be noted that the backlight 202 is not drawn to scale, and the pixel 300D may not include multiple lighting units 304 corresponding thereto. For example, the lighting units 304 of the backlight 302 may represent a totality of the lighting units 304 for an entire display (e.g., for all of the pixels), but is depicted in this way in FIG. 3D for illustrative purposes only. In some embodiments, the individual lighting units 304 may be adjusted to aid in compensating for defective cells, as described herein. For example, assuming that the lighting unit 304A most closely corresponded to (e.g., provided the largest majority of the light to) the pixel 300D, the luminance value of the lighting unit 304A may be adjusted to account for a defective cell—e.g., the cell 302Q in this example. As such, where the cell 302Q is supposed to have a lower value but the cell 302Q is always-open and thus brighter than desired, the luminance value of the lighting unit 304A may be reduced to compensate. In addition, as a result of the luminance value of the lighting unit 304A being reduced, where the lighting unit 304A also corresponds to one or more other pixels, the values applied to the cells 116 of those pixels may also be adjusted to compensate for the adjustment in the luminance to the lighting unit 304A.

Figure 4:
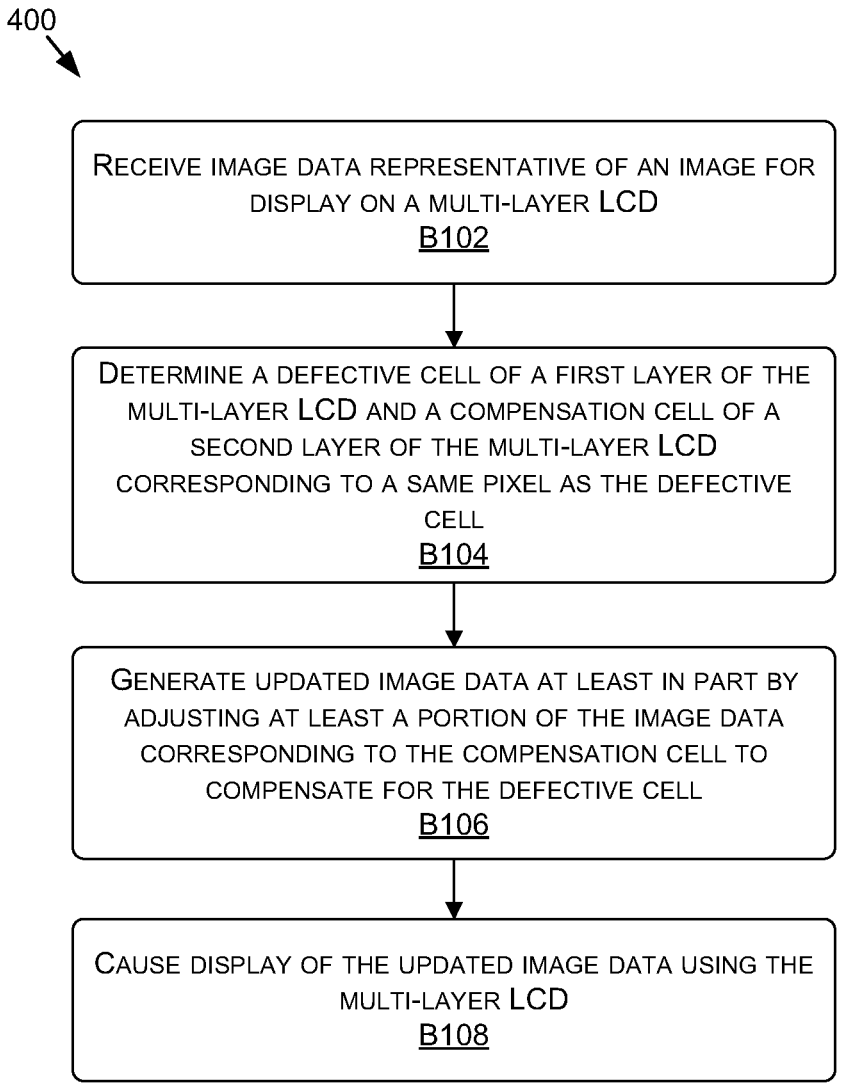
FIG. 4 includes an example flow diagram illustrating a method for defective pixel identification and mitigation, in accordance with some embodiments of the present disclosure.

Now referring to FIG. 4, each block of method 400, described herein, comprises a computing process that may be performed using any combination of hardware, firmware, and/or software. For instance, various functions may be carried out by a processor executing instructions stored in memory. The method 400 may also be embodied as computer-usable instructions stored on computer storage media. The method 400 may be provided by a standalone application, a service or hosted service (standalone or in combination with another hosted service), or a plug-in to another product, to name a few. In addition, method 400 is described, by way of example, with respect to the system 100 of FIG. 1A. However, this method 400 may additionally or alternatively be executed by any one system, or any combination of systems, including, but not limited to, those described herein.

FIG. 4 includes an example flow diagram illustrating a method 400 for defective pixel identification and mitigation, in accordance with some embodiments of the present disclosure. The method 400, at block B402, includes receiving image data representative of an image for display on a multi-layer LCD. For example, the system 100 may receive the image data 154 representative of an image for display on the LCD display of the system 100.

The method 400, at block B404, includes determining a defective cell of a first layer of the multi-layer LCD and a compensation of a second layer of the multi-layer LCD corresponding to a same pixel as the defective cell. For example, the cell determiner 106 may determine a defective cell from the LCD layer 110A and may also determine a compensation cell from the LCD layer 110B that corresponds to a same pixel as the defective cell.

The method 400, at block B406, includes generating updated image data at least in part by adjusting a portion of the image data corresponding to the compensation cell to compensate for the defective cell. For example, the cell compensator 108 may determine compensation information corresponding to the compensation cell and may update one or more values (e.g., color values for cells of the LCD layers 110, voltage values, capacitance values, etc.) to compensate for the defective cell. In some embodiments, as described herein, one or more additional cells that may be affected by the compensation to the compensation cell may also be adjusted to aid in generating a final displayed image that resembles the original image data 154 as closely as possible.

The method 400, at block B408, includes causing display of the updated image data using the multi-layer LCD. For example, the voltage values corresponding to each cell 116 of each LCD layer 110 may be driven—e.g., via the row drivers 114 and the column driver 112—to generate a final display of the updated or compensated image.

Example Computing Device

Figure 5:
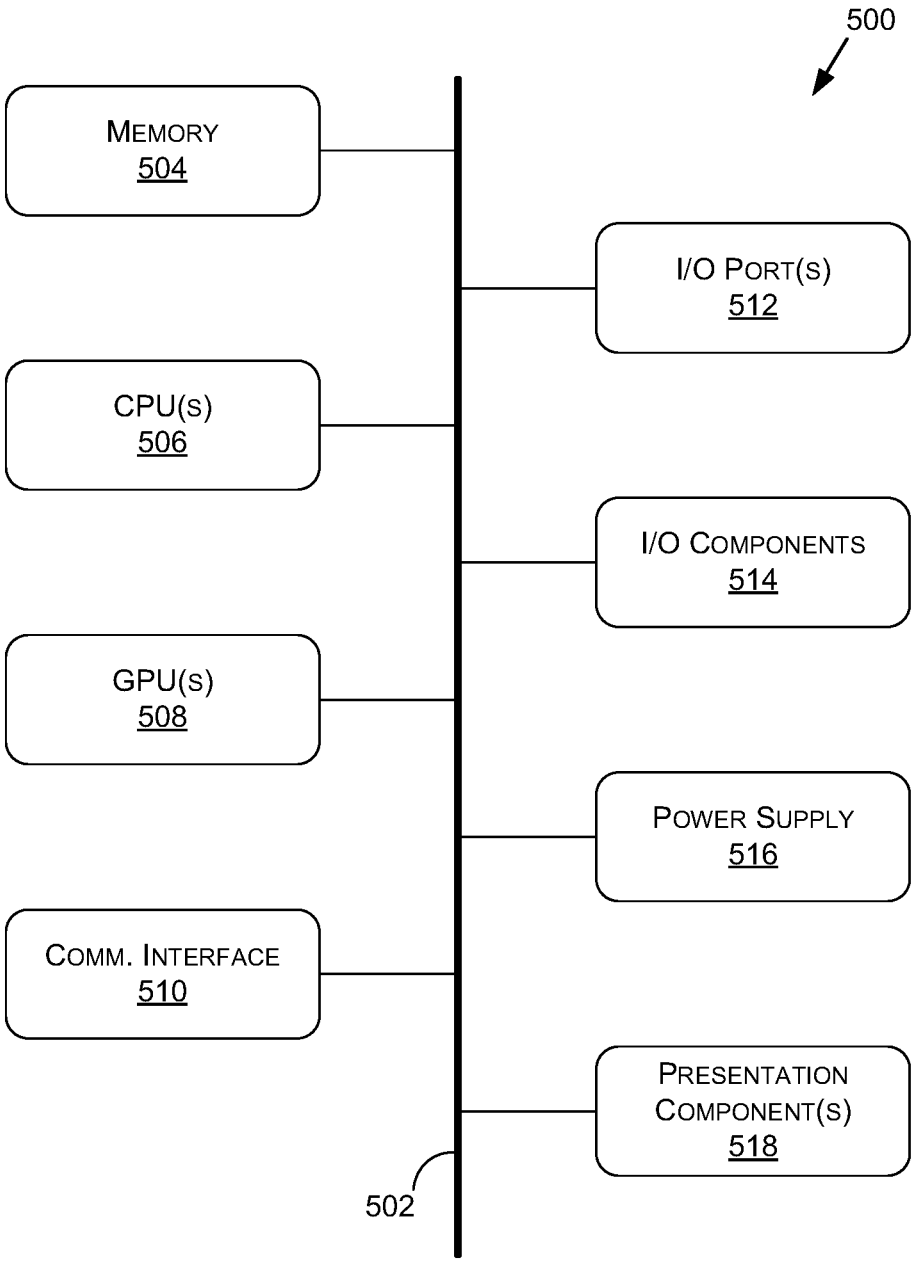
FIG. 5 is a block diagram of an example computing device suitable for use in implementing some embodiments of the present disclosure.

FIG. 5 is a block diagram of an example computing device 500 suitable for use in implementing some embodiments of the present disclosure. Computing device 500 may include a bus 502 that directly or indirectly couples the following devices: memory 504, one or more central processing units (CPUs) 506, one or more graphics processing units (GPUs) 508, a communication interface 510, input/output (I/O) ports 512, input/output components 514, a power supply 516, and one or more presentation components 518 (e.g., display(s)).

Although the various blocks of FIG. 5 are shown as connected via the bus 502 with lines, this is not intended to be limiting and is for clarity only. For example, in some embodiments, a presentation component 518, such as a display device, may be considered an I/O component 514 (e.g., if the display is a touch screen). As another example, the CPUs 506 and/or GPUs 508 may include memory (e.g., the memory 504 may be representative of a storage device in addition to the memory of the GPUs 508, the CPUs 506, and/or other components). In other words, the computing device of FIG. 5 is merely illustrative. Distinction is not made between such categories as "workstation," "server," "laptop," "desktop," "tablet," "client device," "mobile device," "hand-held device," "game console," "electronic control unit (ECU)," "virtual reality system," and/or other device or system types, as all are contemplated within the scope of the computing device of FIG. 5.

The bus 502 may represent one or more busses, such as an address bus, a data bus, a control bus, or a combination thereof. The bus 502 may include one or more bus types, such as an industry standard architecture (ISA) bus, an extended industry standard architecture (EISA) bus, a video electronics standards association (VESA) bus, a peripheral component interconnect (PCI) bus, a peripheral component interconnect express (PCIe) bus, and/or another type of bus.

The memory 504 may include any of a variety of computer-readable media. The computer-readable media may be any available media that may be accessed by the computing device 500. The computer-readable media may include both volatile and nonvolatile media, and removable and non-removable media. By way of example, and not limitation, the computer-readable media may comprise computer-storage media and communication media.

The computer-storage media may include both volatile and nonvolatile media and/or removable and non-removable media implemented in any method or technology for storage of information such as computer-readable instructions, data structures, program modules, and/or other data types. For example, the memory 504 may store computer-readable instructions (e.g., that represent a program(s) and/or a program element(s), such as an operating system. Computer-storage media may include, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by computing device 500. As used herein, computer storage media does not comprise signals per se.

The communication media may embody computer-readable instructions, data structures, program modules, and/or other data types in a modulated data signal such as a carrier wave or other transport mechanism and includes any information delivery media. The term "modulated data signal" may refer to a signal that has one or more of its characteristics set or changed in such a manner as to encode information in the signal. By way of example, and not limitation, the communication media may include wired media such as a wired network or direct-wired connection, and wireless media such as acoustic, RF, infrared and other wireless media. Combinations of any of the above should also be included within the scope of computer-readable media.

The CPU(s) 506 may be configured to execute the computer-readable instructions to control one or more components of the computing device 500 to perform one or more of the methods and/or processes described herein. The CPU(s) 506 may each include one or more cores (e.g., one, two, four, eight, twenty-eight, seventy-two, etc.) that are capable of handling a multitude of software threads simultaneously. The CPU(s) 506 may include any type of processor, and may include different types of processors depending on the type of computing device 500 implemented (e.g., processors with fewer cores for mobile devices and processors with more cores for servers). For example, depending on the type of computing device 500, the processor may be an ARM processor implemented using Reduced Instruction Set Computing (RISC) or an x86 processor implemented using Complex Instruction Set Computing (CISC). The computing device 500 may include one or more CPUs 506 in addition to one or more microprocessors or supplementary co-processors, such as math co-processors.

The GPU(s) 508 may be used by the computing device 500 to render graphics (e.g., 3D graphics). The GPU(s) 508 may include hundreds or thousands of cores that are capable of handling hundreds or thousands of software threads simultaneously. The GPU(s) 508 may generate pixel data for output images in response to rendering commands (e.g., rendering commands from the CPU(s) 506 received via a host interface). The GPU(s) 508 may include graphics memory, such as display memory, for storing pixel data. The display memory may be included as part of the memory 504. The GPU(s) 708 may include two or more GPUs operating in parallel (e.g., via a link). When combined together, each GPU 508 may generate pixel data for different portions of an output image or for different output images (e.g., a first GPU for a first image and a second GPU for a second image). Each GPU may include its own memory, or may share memory with other GPUs.

In examples where the computing device 500 does not include the GPU(s) 508, the CPU(s) 506 may be used to render graphics.

The communication interface 510 may include one or more receivers, transmitters, and/or transceivers that enable the computing device 700 to communicate with other computing devices via an electronic communication network, included wired and/or wireless communications. The communication interface 510 may include components and functionality to enable communication over any of a number of different networks, such as wireless networks (e.g., Wi-Fi, Z-Wave, Bluetooth, Bluetooth LE, ZigBee, etc.), wired networks (e.g., communicating over Ethernet), low-power wide-area networks (e.g., LoRaWAN, SigFox, etc.), and/or the Internet.

The I/O ports 512 may enable the computing device 500 to be logically coupled to other devices including the I/O components 514, the presentation component(s) 518, and/or other components, some of which may be built in to (e.g., integrated in) the computing device 500. Illustrative I/O components 514 include a microphone, mouse, keyboard, joystick, game pad, game controller, satellite dish, scanner, printer, wireless device, etc. The I/O components 514 may provide a natural user interface (NUI) that processes air gestures, voice, or other physiological inputs generated by a user. In some instances, inputs may be transmitted to an appropriate network element for further processing. An NUI may implement any combination of speech recognition, stylus recognition, facial recognition, biometric recognition, gesture recognition both on screen and adjacent to the screen, air gestures, head and eye tracking, and touch recognition (as described in more detail below) associated with a display of the computing device 500. The computing device 500 may be include depth cameras, such as stereoscopic camera systems, infrared camera systems, RGB camera systems, touchscreen technology, and combinations of these, for gesture detection and recognition. Additionally, the computing device 500 may include accelerometers or gyroscopes (e.g., as part of an inertia measurement unit (IMU)) that enable detection of motion. In some examples, the output of the accelerometers or gyroscopes may be used by the computing device 500 to render immersive augmented reality or virtual reality.

The power supply 516 may include a hard-wired power supply, a battery power supply, or a combination thereof. The power supply 516 may provide power to the computing device 500 to enable the components of the computing device 500 to operate.

The presentation component(s) 518 may include a display (e.g., a monitor, a touch screen, a television screen, a heads-up-display (HUD), other display types, or a combination thereof), speakers, and/or other presentation components. The presentation component(s) 518 may receive data from other components (e.g., the GPU(s) 508, the CPU(s) 506, etc.), and output the data (e.g., as an image, video, sound, etc.).

The disclosure may be described in the general context of computer code or machine-useable instructions, including computer-executable instructions such as program modules, being executed by a computer or other machine, such as a personal data assistant or other handheld device. Generally, program modules including routines, programs, objects, components, data structures, etc., refer to code that perform particular tasks or implement particular abstract data types. The disclosure may be practiced in a variety of system configurations, including hand-held devices, consumer electronics, general-purpose computers, more specialty computing devices, etc. The disclosure may also be practiced in distributed computing environments where tasks are performed by remote-processing devices that are linked through a communications network.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

What is claimed is:

1. A method comprising:

receiving image data indicative of, at least in part, a final color value corresponding to a pixel of an image;

based at least in part on the final color value, determining a first capacitance value corresponding to a first color value of a first cell of a first layer of a multi-layer liquid crystal display (LCD) and a second capacitance value corresponding to a second color value of a second cell of a second layer of the multi-layer LCD, the first cell and the second cell positioned to correspond to the pixel;

determining that the first cell is defective;

adjusting the second capacitance value to an updated capacitance value corresponding to a third color value of the second cell different from the second color value to compensate for the first cell being defective; and driving the updated capacitance value to the second cell during display of the image.

2. The method of claim 1, further comprising storing data corresponding to the first cell being defective in memory, wherein the determining that the first cell is defective includes accessing the data in memory.

3. The method of claim 2, wherein the adjusting the second capacitance value to the updated capacitance value is based at least in part on the data.

4. The method of claim 1, wherein:

the first cell corresponds to a first sub-pixel of the pixel and a third cell of the first layer corresponds to a second sub-pixel of the pixel; and the second cell of the second layer corresponds to both the first sub-pixel and the second sub-pixel, the method further comprising:

adjusting a third capacitance value corresponding to a fourth color value of the third cell based at least in part on the updated capacitance value of the second cell.

5. The method of claim 1, further comprising:

adjusting at least one lighting unit of a backlight of the multi-layer LCD based at least in part on the determining that the first cell is defective, the at least one lighting unit providing, at least in part, backlighting to the pixel.

6. The method of claim 1, further comprising:

displaying a first diagnostic image on the multi-layer LCD;

capturing a second diagnostic image representative of the first diagnostic image using a device including a camera;

analyzing the second diagnostic image;

determining that one or more cells of the multi-layer LCD are defective based at least in part on the analyzing; and storing data representative of the one or more cells being defective in memory, wherein the determining that the first cell is defective is based at least in part on the data.

7. The method of claim 6, further comprising:

displaying a diagnostic image on the multi-layer LCD;

receiving first data representative of an input corresponding to a portion of the diagnostic image;

determining one or more cells of the multi-layer LCD that correspond to the portion of the diagnostic image; and storing second data representative of the one or more cells being defective in memory, wherein the determining that the first cell is defective is based at least in part on the second data.

8. The method of claim 7, wherein the input is provided using at least one of a touch screen, a mouse, a remote, or a stylus.

9. The method of claim 1, wherein the first layer corresponds to an multicolor layer of the multi-layer LCD, the second layer corresponds to a monochrome layer of the multi-layer LCD, the first cell corresponds to one of a first color sub-pixel or a second color sub-pixel of the pixel in the multicolor layer, and the second cell corresponds to a monochrome sub-pixel of the pixel in the monochrome layer.

10. A method comprising:

receiving image data representative of an image for display on a multi-layer liquid crystal display (LCD);

determining a defective cell of a first layer of the multi-layer LCD and a compensation cell of a second layer of the multi-layer LCD corresponding to a same pixel as the defective cell;

generating updated image data at least in part by adjusting at least a portion of the image data corresponding to the compensation cell to compensate for the defective cell; and causing display of the updated image data using the multi-layer LCD such that a first output of the defective cell and a second output of the compensation cell each contribute to a color of the same pixel in the display of the updated image data.

11. The method of claim 10, wherein the causing display of the updated image data includes at least driving a voltage corresponding to a final capacitance value to the compensation cell, the final capacitance value being different from an initial capacitance value that would correspond to the compensation cell if the image data were displayed.

12. The method of claim 10, wherein:

the defective cell corresponds to a sub-pixel of the same pixel;

an additional cell of the first layer corresponds to another sub-pixel of the same pixel; and the generating the updated image data further includes adjusting at least another portion of the image data corresponding to the additional cell to compensate for the adjusting at least the portion of the image data corresponding to the compensation cell.

13. The method of claim 12, wherein the additional cell further contributes to the color of the same pixel in the display of the updated image data.

14. The method of claim 10, wherein:

the compensation cell further corresponds to an additional pixel other than the same pixel; and the generating the updated image data further includes adjusting at least another portion of the image data corresponding to an additional cell of the first layer corresponding to the additional pixel to compensate for the adjusting at least the portion of the image data corresponding to the compensation cell.

15. The method of claim 10, wherein the first layer and the second layer each correspond to one of an RGB layer or a monochrome layer.

16. A liquid crystal display (LCD) comprising:

a first liquid crystal (LC) layer;

a second LC layer;

one or more memory devices storing programmed instructions thereon, at least one of the one or more memory devices storing data representative of a location of a defective cell of the first LC layer;

one or more processing devices communicatively coupled to the one or more memory devices, the one or more processing devices, when executing the programmed instructions, cause an instantiation of:

a defective cell compensator to, based at least in part on the data, generate updated image data including an updated color value with respect to an initial color value from initial image data, wherein the updated color value corresponds to a compensation cell of the second LC layer corresponding to a same pixel as the defective cell of the first LC layer; and a driver controller to cause a capacitance corresponding to the updated color value to be applied to the compensation cell of the second LC layer when displaying the updated image data such that an output of the defective cell and an output of the compensation cell contribute to a final output of the same pixel during the displaying.

17. The LCD of claim 16, wherein:

the defective cell corresponds to a first sub-pixel of the pixel;

a functioning cell corresponds to a second sub-pixel of the pixel;

the compensation cell further corresponds to the functioning cell; and the updated image data further includes an additional updated color value corresponding to the functional cell to compensate for the updated color value corresponding to the compensation cell.

18. The LCD of claim 16, further comprising a backlight including a plurality of lighting units, wherein the one or more processing devices, when executing the programmed instructions, further cause an instantiation of:

a backlight modulator to, based at least in part on the data, adjust at least one of the plurality of lighting units to compensate for the defective cell.

19. The LCD of claim 18, wherein the plurality of lighting units each include a light-emitting diode (LED).

20. The LCD of claim 16, wherein the first LC layer and the second LC layer each correspond to one of an RGB layer or a monochrome layer.

* * * * *